United States Patent [19]

Fischer

[11] Patent Number: 4,838,781

[45] Date of Patent: Jun. 13, 1989

[54] CONTAINERIZED FUEL FIREPLACE INSERT

[76] Inventor: Erwin C. Fischer, 745 N. State St., Hildale, Utah 84784

[21] Appl. No.: 242,716

[22] Filed: Sep. 12, 1988

[51] Int. Cl.[4] ..... F23Q 2/32

[52] U.S. Cl. ..... 431/125; 431/152; 426/512

[58] Field of Search ..... 431/125, 152, 150, 331, 431/332; 126/92 R, 285 R, 25 C, 25 B, 512, 86, 93; 40/428

[56] References Cited

U.S. PATENT DOCUMENTS

| | | | |
|---|---|---|---|
| 4,076,490 | 2/1978 | Hilker | 431/125 |
| 4,573,905 | 3/1986 | Meyers | 126/127 |
| 4,582,478 | 4/1986 | Hilker | 431/125 |
| 4,637,372 | 1/1987 | Mogol | 431/125 |
| 4,726,351 | 2/1988 | Whittaker et al. | 431/125 |

FOREIGN PATENT DOCUMENTS

| | | | |
|---|---|---|---|
| 48312 | 12/1983 | European Pat. Off. | 431/125 |

*Primary Examiner*—James C. Yeung

*Attorney, Agent, or Firm*—Thorpe, North & Western

[57] ABSTRACT

A burner unit holding simulated logs and particularly adapted for the burning of unvented containerized fuels is described which provides for easy ignition and replacement of fuel containers and controlling the burning rate of fuel. Into a support stand is mounted a pivotable grate containing a fuel cell housing at the rear portion thereof. By tilting the grate forwardly cans of fuel in the housing are easily exposed for replacement or ignition. Damper lid means are slidably contained in an assembly above the fuel cell housing to cover and extinguish the flame of ignited fuel containers. The damper lid is contained by guide tabs in slots which allows the damper lid to be moved to partially cover the fuel containers to dampen and control the burning rate. When the damper lid is fully open it rotates in the slot to a vertical position behind the fuel cell housing. The rotation of the damper lid from horizontal to vertical position requires only minimal space behind the burner unit. Preferably, the burner unit is contained in a fire box.

11 Claims, 4 Drawing Sheets

CONTAINERIZED FUEL FIREPLACE INSERT

BACKGROUND OF THE INVENTION

1. Field of the Invention

This invention relates to a fireplace insert for the burning of containerized fuel. More particularly, this invention relates to a burner unit suitable for use in fireplaces which do not require the venting of combustion products through a chimney.

2. Prior Art

A fireplace was once considered to be a necessity in every home for practical purposes of heating and cooking. In more recent times, however, such units have been considered more of a luxury and may often be used more for decorative than functional purposes. While sitting before a warm blazing fire on a winter night is a pleasure, it is often reserved to the more affluent due to the expense associated with having a fireplace. For example, a chimney or other appropriate ventilation means is required. Also the fireplace must be constructed with proper brickwork and other masonry to assure that a fire in the fireplace will be contained. Fireplaces are often inefficient in that much of the heat from a fire escapes up the chimney. Also, if the damper is left open cold air comes down the chimney and cools the room. If the damper is closed when a fire is lighted, or if the chimney doesn't draw sufficiently, smoke and other products of combustion enter the room and are a health hazard as well as causing immediate discomfort and irritation.

An alternative to a conventional fireplace is a ventless fireplace which burns a fuel such as ethanol that is completely combustible into carbon dioxide and water thereby leaving no dangerous by-products, smoke or residue. Because such units are ventless, they can be made portable and moved from room to room as the need requires. Or, in the alternative, they can be built into a wall, closet and the like and surrounded with a facade such as a mantle or console and have the appearance of a conventional fireplace. In such installations, the burner unit is generally contained in a fire box.

U.S. Pat. No. 4,573,905 discloses a burner unit for burning of containerized alcohol based fuels and provides a listing of prior art both in terms of references cited and those referred to in the background portion. However, one of the problems associated with prior art units is that the containerized alcohol is often difficult to ignite because the fuel cans are placed in a fuel cell located between simulated logs and may not be easily accessible. Cans of gelled fuel often come in different sizes and most prior art units are adapted to accommodate only one size of container. Also if a burner unit contains a lid to cover the gelled fuel to put it out, the unit must be located sufficiently away from the back wall of a fire box to allow the lid to move backwards in a horizontal plane to uncover the container for lighting. This requires space which is otherwise unnecessary.

OBJECTS AND SUMMARY OF THE INVENTION

It is an object of the present invention to provide a burner unit for holding containerized fuel for insertion into a fire box which allows for convenient access to the fuel containers for lighting and also loading and unloading of containers.

It is also an object of the present invention to provide a burner unit which is capable of holding different sizes of fuel containers without inhibiting the functionality of the unit.

A further object of the present invention is to provide a burner unit for containerized gelled fuels having damping means which allows for the controlling of the burn rate of the fuel by damping of the air flow from positions varying between fully open through fully closed.

An additional object of the invention is to provide a burner unit wherein the damping means rotates from a horizontal to a vertical position between the unit and the back wall of the fire box when fully open thereby requiring minimal clearance between the burner unit and back of the fire box for the damping operation.

These and other objects will become apparent from the summary, drawings and detailed description which follow.

The burner unit is made up of a pivoting grate having a fuel cell housing as an integral part thereof mounted to a support stand. The grate preferably consists of a series of parallel grate bars having upwardly extending forward ends. To the rear portion of the bars is transversely mounted a fuel cell housing having a floor, and, extending upwardly at right angles between the forward ends of the grate bars and the fuel cell housing provides an area for a first simulated log holder. The grate is pivotally mounted in the support stand between parallel side rails which terminate at either end in downwardly extending legs. Interconnecting the side rails at the rear portions are transverse bars against which the rear edges of the grate bars and floor of the fuel cell housing may rest in a horizontal position. The outermost grate bars on either side of the grate are pivotally mounted to the inside edges of the forward portion of the side rails. Means are located on the inside of the forward legs of the support stand to limit the forward pivot or rotation of the grate to about 45°.

A damper assembly is provided comprising endwalls, an upper log holder and a damper lid slidably mounted in grooves in the upper portion of the endwalls.

Endwalls for the fuel cell housing protrude upwardly from the side rails such that the upper portion extends above the front wall of the fuel cell housing. A damper lid is located in an offset generally horizontal groove contained in the upper portion of the endwalls. The groove has sufficient depth that the damper lid has room for vertical adjustment to accommodate different fuel container heights in the fuel cell housing. The offset groove has a lower first horizontal level which slopes upwardly and rearwardly to a second elevated horizontal level. A control eyelet or other handle means on the top of the lid provide for use of a tool to slide the damper lid across the top of the fuel cell along the limits set by the length of the groove.

Interconnecting the upper rear edges of the endwalls is a second simulated log holder. Thus, the first simulated log holder is to be found in the over the pivot connection between the upwardly extending grate bar ends and front wall of the fuel cell housing and the second simulated log holder interconnects the endwalls in the manner stated.

The pivot point of the grate is such that the grate, containing the first simulated log, can be pivoted forwardly about 45° and remain in that position to allow fuel containers to be added or removed from the container and also to be ignited. Once ignited, the grate can be pivoted back to a horizontal position.

With the damper lid in a closed position, the grate cannot be rotated. However, by pushing the damper lid backwardly to the groove offset and beyond, the front edge of the lid rotates upwardly and the rear edge rotates downwardly. As the lid reaches the second elevated horizontal level of the groove the lid has rotated into a vertical position and hangs behind the fuel cell housing leaving the fuel containers fully open. The rotation of the damper lid requires minimal clearance behind the fuel cell housing for rotation to occur.

With the lid in the open position the grate can be rotated to expose the fuel containers allowing the fuel to be easily ignited. To dampen the burning rate, the lid is pulled forwardly by the tool down the offset slope to a resting position on the fuel cell containers. In that position the fuel containers are only partially open and the burning rate is slower due to less air entering the fuel containers. When the damper lid is pulled fully forward, the fuel containers are fully covered and any flame is extinguished.

DETAILED DESCRIPTION OF THE INVENTION

Figure 1:
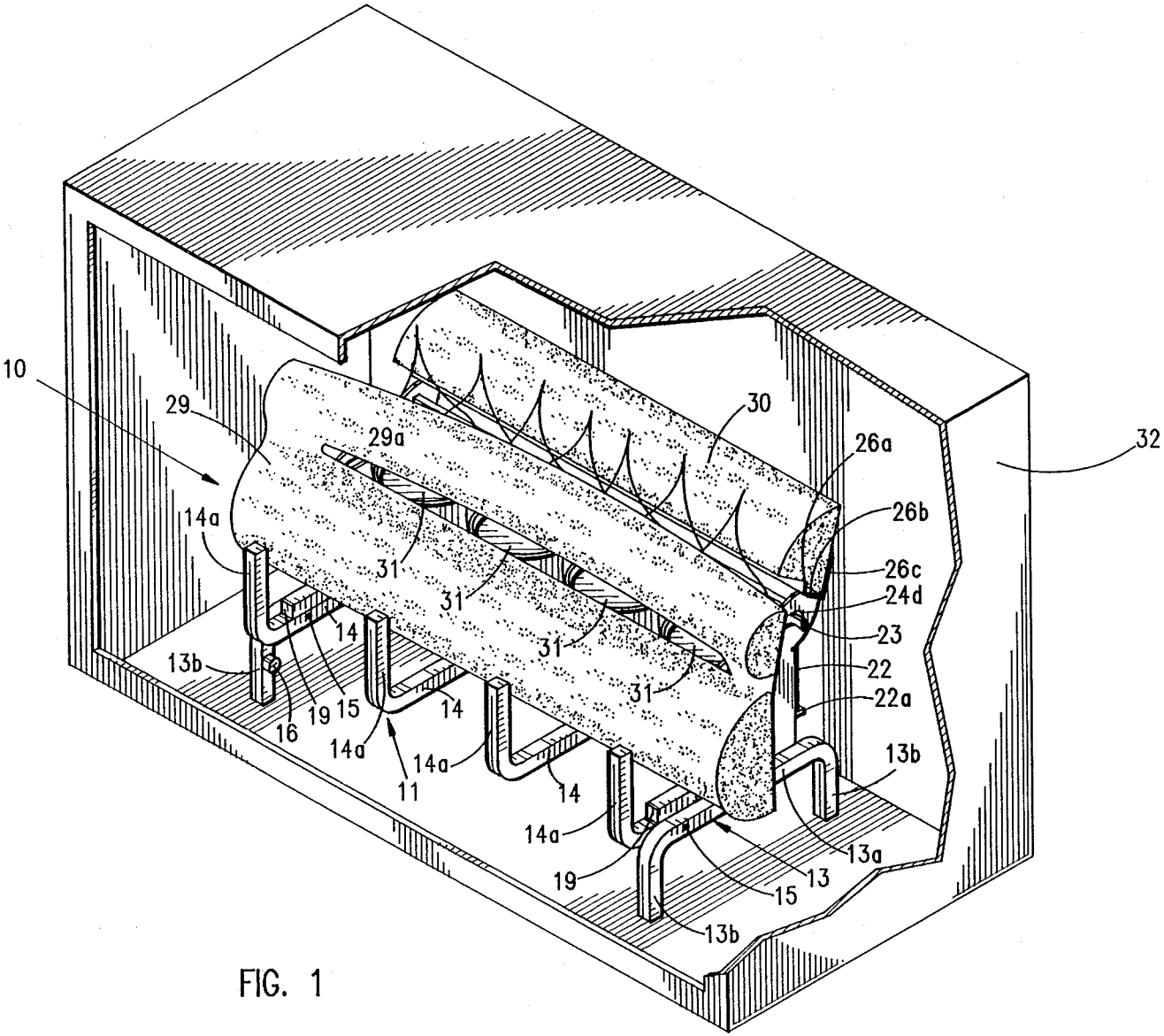
FIG. 1 is a perspective view of the burner unit, containing simulated logs in place in a firebox showing the fuel containers ignited.

There is shown in FIGS. 1–7 a complete and preferred embodiment of the invention. FIG. 1 shows an burner unit 10 housed in a fire box 32 having the fuel in fuel containers 31 ignited FIGS. 2–7 specifically illustrate the burner unit 10. The burner unit 10 has a grate 11 pivotally mounted to the forward portion of a support base or stand 13. The grate 11 is made up of a series of spaced apart parallel grate bars 14 which curve upwardly at their forward ends **14*a*. Transversely attached to the rear portion of the grate bars 14, and holding them in an interconnected position, is a fuel container housing 12 consisting of a front wall 12*a*, a floor 12*b* and a partial back wall which extends upwardly from the floor to form a lip 12*c* to prevent backward movement of the fuel containers 31. The portion of the grate forward of the fuel cell housing 12 and behind the upwardly extending forward ends of the grate bars 14*a* provides a space for holding a front simulated log 29 transverse to the grate bars 14 and parallel to the fuel cell housing 12. Front simulated log 29 simulates the appearance of one or more real logs piled on each other and, as shown, has an aperture 29*a*, between logs through which the damper assembly may be operated by a tool as will be described. Rear simulated log 30 rests in a channel of an upper log holder 26 behind and above the fuel cell housing 12. Thus, when the fuel in containers 31 is ignited, the flame appears between the front and rear logs 29 and 30** respectively giving a appearance of a wood burning fire.

Figure 2:
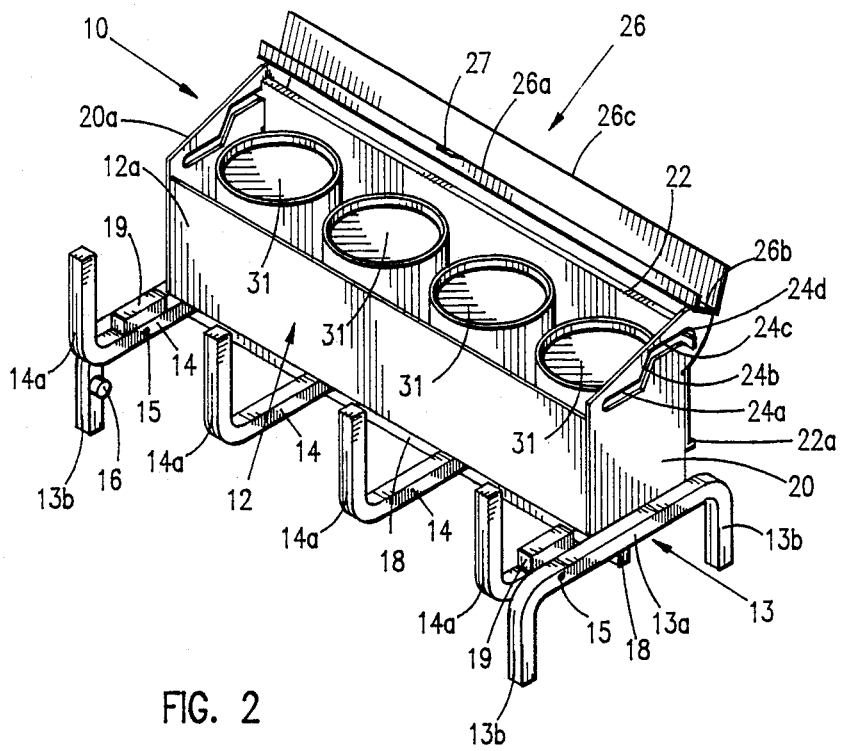
FIG. 2 is a perspective view of the burner unit shown in FIG. 1, without simulated logs, and not contained in a fire box.
Figure 3:
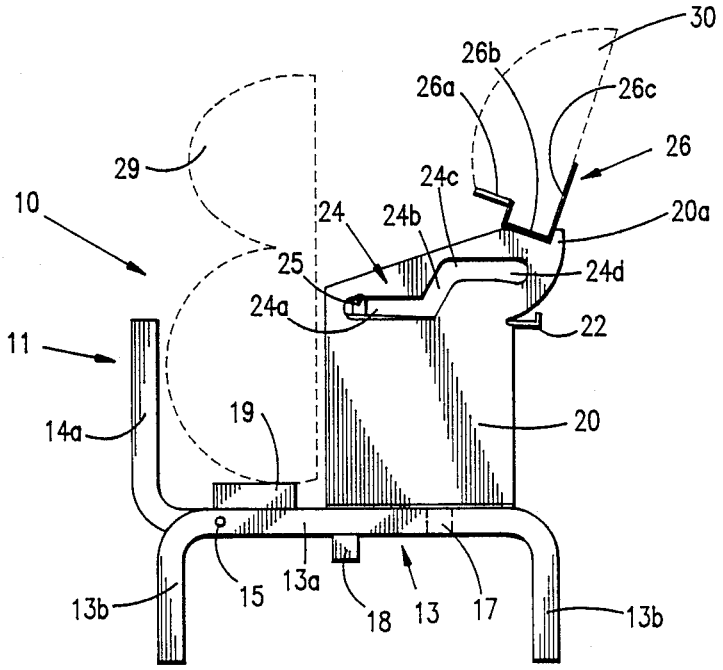
FIG. 3 is a side elevation view of the burner unit shown in FIG. 2 showing the simulated logs in dotted lines and the damper lid in a closed position.
Figure 4:
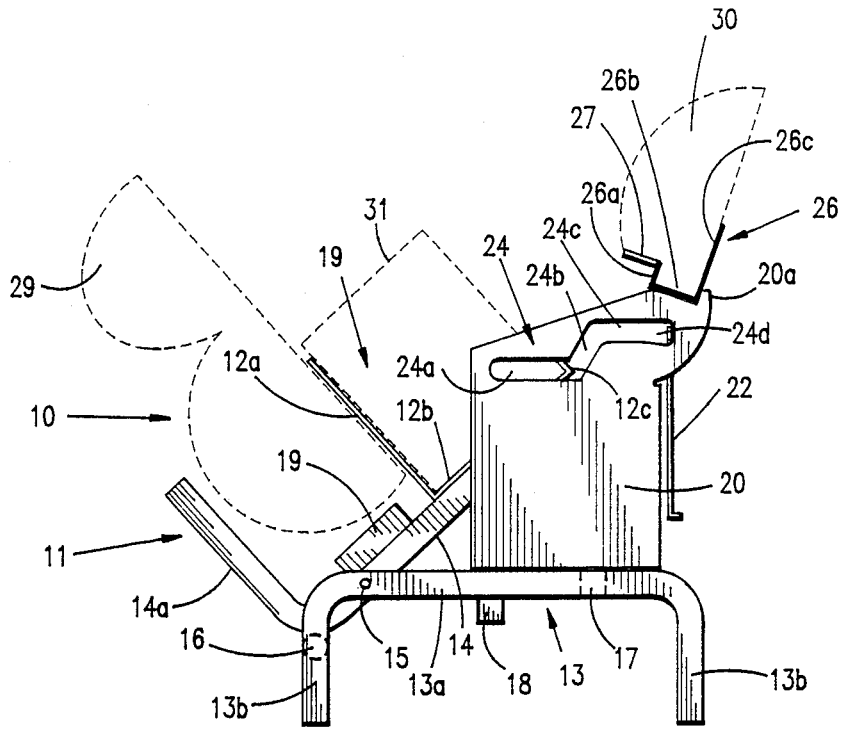
FIG. 4 is a side elevation view of the burner unit shown in FIG. 2 with the damper lid in a fully open vertical position and the grate in a forwardly tilted position.
Figure 5:
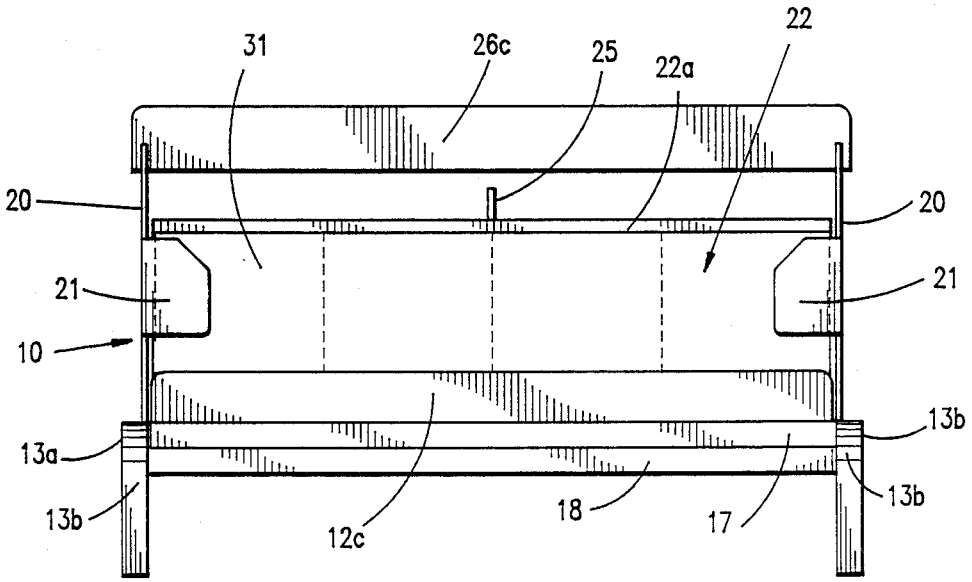
FIG. 5 is a back elevation view of the burner unit shown in FIG. 3.

The support base 13, as shown in FIGS. 1 through 5, is made up of parallel side rails **13*a* at either side of the burner unit which terminate in downwardly extending forward and rear legs 13*b*. Interconnecting the side rails 13*b* to the rear of the pivot connection are transverse support bars upon which the rear ends of the grate bars and floor of the fuel cell housing rest when in a non-pivoted horizontal position. The rearmost transverse bar 17 is secured between side rails 13*a* in the same horizontal plane as shown in FIG. 3–5. The floor 12*b* of the fuel cell housing 12 rests on this bar when the grate is in a horizontal position. The other transverse bar 18 is longer than bar 17 and is secured to the lower surfaces of the side rails 13*a* forward of bar 17 to form a rest for grate bars 14 when they are in a horizontal position as shown in FIGS. 1–5. The outermost grate bars are pivotally connected to the forward portion of the side rails 13*a* by pivot pins 15. Thus, when in an upright or non-tilted position, the grate bars 14 and floor 12*b* of the fuel cell housing rest on transverse bars 17 and 18. In this position the grate bars 14 and side rails 13*a* of the support base are in the same horizontal plane. A grate stop 16 is affixed to an inside surface of one or both forward legs 13*b* of the support base 13 to limit the angle which the grate 11** can pivot to about 45°.

A damper assembly consisting of endwalls, a log holder and slidably mounted damper lid, complete the unit.

As best shown in FIGS. 2–7, connected to the side rails **13*a* and in alignment with the inner surfaces thereof and extending upwardly therefrom are endwalls 20 having the same width as the width of the fuel cell housing 12. These opposing endwalls 20 define the ends of the fuel cell and confine the fuel cell containers 31 from longitudinal movement in the housing. Stop tabs 21 for a damper lid are integral with the endwalls and extend inwardly therefrom at right angles to the endwalls as shown in FIG. 5. The upper portion 20*a* of the endwalls extends above the fuel cell housing 12 and also angles to be rearward of a vertical plane defined by the stop tabs 21. This upper endwall section 20*a* contains a generally horizontal damper lid slot or groove 24 which is offset with the forward horizontal portion of the slot 24*a* being at a lower first level and then angling upwardly and rearwardly midway along the slot at 24*b* to a rear horizontal portion 24*c* at a second elevated level. The rear portion of slot 24 ends has an enlarged opening 24*d*** to allow the damper lid assembly to hang vertically as will be described. The slot has a depth which is greater than the thickness of the guide tabs of the damper lid to allow the damper to float in the slot and adjust for different fuel container heights as will be explained.

Mounted to the upper rear portion of the endwalls **20*a* and interconnecting them is an upper simulated log holder 26. This holder is a J shaped channel angled backwardly having a front lip 26*a*, a floor 26*b* which slopes downwardly from the front lip 26*a* and a back 26*c* which then angles upwardly and rearwardly from the floor 26*b*. One or more support brackets 27 may extend outwardly away from the upper edge of the front lip 26***a* to provide additional resting support for a simulated log 30 resting in the J shaped channel.

The final, but perhaps most critical, element of the damper unit assembly is a damper lid 22 configured to fit over and cover the fuel cell housing 12 when the lid is in a closed position. The lid 22 is a generally rectangular piece of material which may contain lips 22*a* extending upwardly on either front or rear edge thereof to provide additional strength. The lid 22 has a longitudinal length the same as the fuel cell housing and has guide tabs 23 extending outwardly from the ends thereof. Guide tabs 23 are located in the forward portion of the lid and are slidably engaged into the damper slots 24 of the upper endwall section 20*a*. A control eyelet 25 or other handle or moving means is secured to the upper lid surface adjacent the forward edge midway along the longitudinal length of the damper lid.

When assembled, a first simulated log 29 is placed in the space between the upward extensions 14*a* of the grate bars and the front wall 12*a* of the fuel cell housing 12 and a second simulated log 30 is contained in the upper log holder 26 interconnecting the upper portions of the endwalls 20*a*. The grate is weighted such that when the grate 11 containing the first simulated log 29 is pivoted forwardly about 45° about pivot pins 15, the grate 11 will remain in the pivoted position as shown in FIG. 4. Cans of gelled fuel 31 can be easily placed in or removed from the fuel cell housing 12 in the pivoted position. Also, from that position the open cans of fuel can easily be ignited. When the grate 11 is pivoted backwardly to an upright or horizontal position as shown in FIGS. 2 and 3, the simulated first log 29 will shield the fuel cell housing 12 and cans of gelled fuel 31 from view. The fuel cell housing 12 is never completely enclosed and allows for ventilation around the fuel containers. When the damper lid 22 is over the top of the fuel cell housing 12, the back of the housing is open being only partially covered by lip 12*c* and stop tabs 21 as shown in FIG. 5. When the lid 22 is in a vertical position as shown in FIGS. 2 and 4 the top of the fuel cell housing is open to allow for burning of fuel or for the pivoting of the grate 11.

Figure 6:
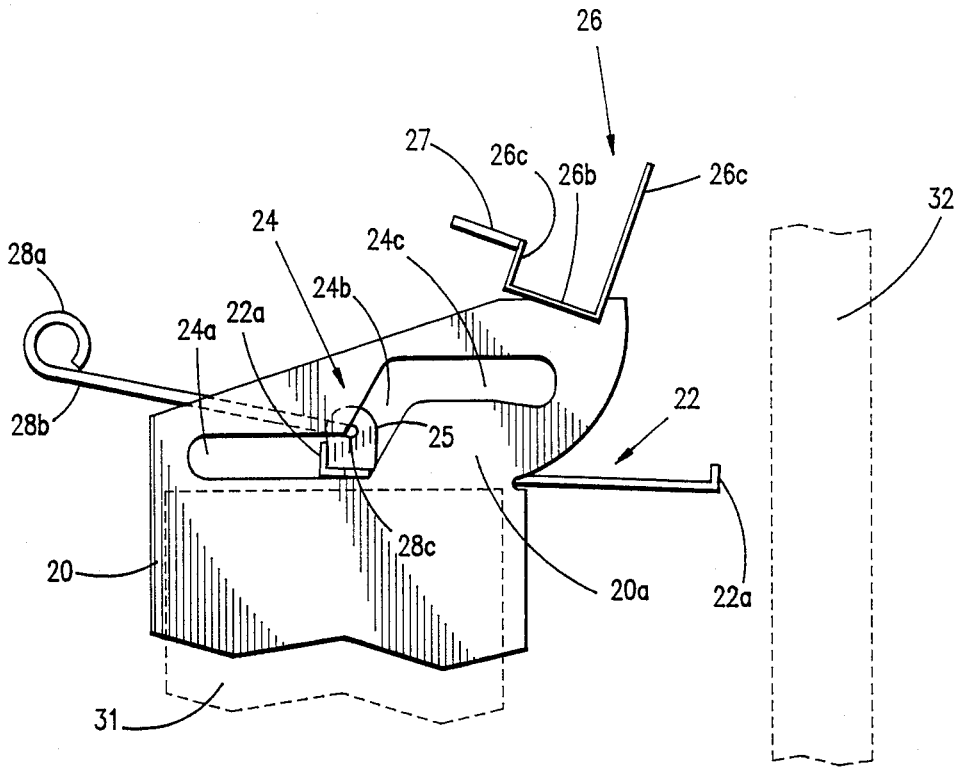
FIG. 6 is a partial side elevation view of the damper lid and endwall assembly showing the damper lid in a partially open position and also showing the proximity of the damper lid to the back wall of a fire box.
Figure 7:
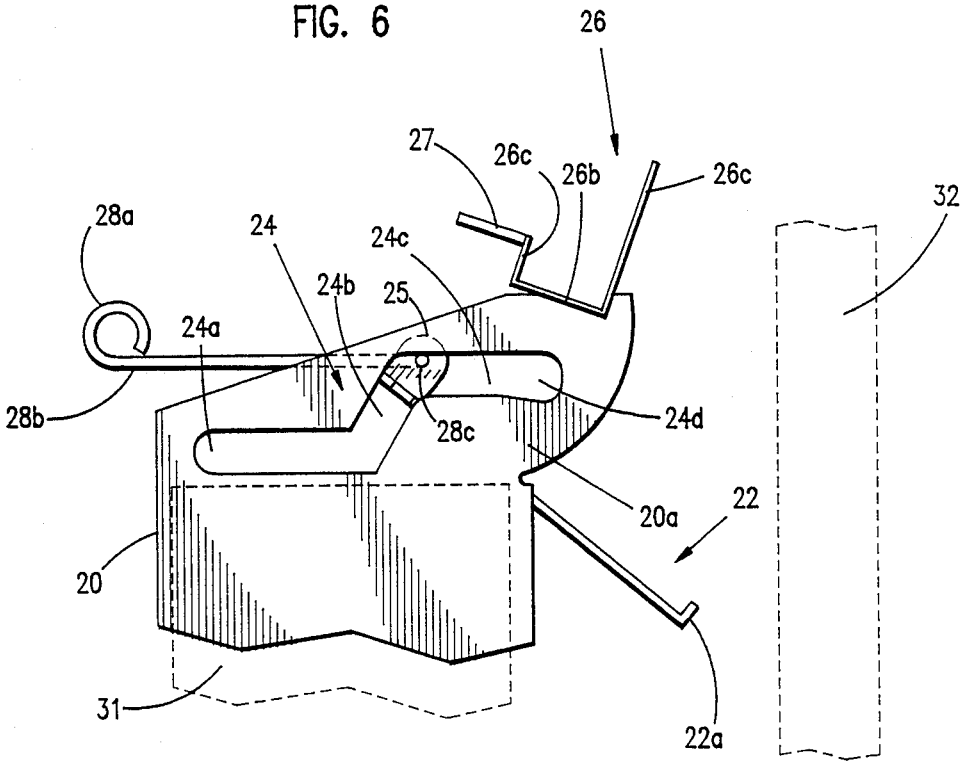
FIG. 7 is a partial side elevation view of the damper lid and endwall assembly similar to FIG. 6 but showing the damper lid in a partially rotated position.

The damper lid 22 adjusts in a horizontal plane in the damper groove 24 from front to back across the width of the fuel cell housing 12 to control or dampen the burning rate of the containerized fuel and floats vertically in the lower horizontal groove section 24*a* to accommodate for the height of the fuel containers 31. A damper tool 28 is shown in FIGS. 6 and 7 and consists of a shaft 28*b* having a finger loop 28*a* at one end and a hook 28*c* extending at right angles from the shaft 28*b* at the other end allows for controlling the damping operation of the lid 22. When the damper lid 22 is pulled forward over the fuel cell housing with the guide tabs 23 resting at the forward edge of lower groove portion 24*a* as in FIG. 2, the fuel containers 31 are closed. The hook end 28*c* of damper tool 28 may be inserted into the control eyelet 25 and the lid 22 pushed backward to uncover the fuel containers 31. As the lid tabs 23 slide backward in the first or lower horizontal portion of the damper groove 24*a* the fuel cans 31 are partially uncovered as shown in FIG. 6. When the guide tabs 23 encounter the sloping section 24*b* of groove 24, the front edge of the lid 22 and the guide tabs 23 rotate upwardly and the rear edge of the lid tilts downwardly further exposing the fuel containers 31 to the open atmosphere as shown in FIG. 7. As the lid tabs 23 reach the elevated portion 24*c* of groove 24 the guide tabs 23, having a width less that the width of the groove, rotate to a completely vertical position and guide tabs 23 reside in the enlarged end 24*d* of groove 24 and the lid 22 rests in a vertical position against the stop tabs 23 extending inwardly from the endwalls 20 at the back of the fuel cell housing 12 as shown in FIGS. 2 and 4. In that position, the fuel containers 31 are fully open. It is in that position that the grate 11 can be pivoted for purposes of igniting the fuel or adding or removing fuel containers as shown in FIG. 4. It may be seen from FIGS. 3, 6, 7 and 4, in that order, when lid 22 is being moved backwardly from a horizontal to a vertical position, only minimal space between the back of the burner unit 10 and fire box 32 is required.

Although not specifically illustrated, when it is desired to control or dampen the flame coming from the ignited fuel containers 31, the control tool 28 is passed through an opening in the first simulated log 29, over the open fuel cell housing and the hook end 28*c* is inserted into the control eyelet 25. Using tool 28 the lid 22 is then pulled forward. As the guide tabs 23 slide out of the enlarged opening 24*d* through the horizontal second elevated groove position 24*c*, to the position shown in FIG. 7, and down the groove slope 24*b* to the first horizontal groove position 24*a* as shown in FIG. 6, the lid 22 rotates to a horizontal position and comes to rest on the upper edge of the fuel containers 31 covering about half the open surface thereof as shown in FIG. 6. In this position, the burning fuel is dampened since less air is available in the container for combustion. To completely extinguish the flame the lid 22, using the control tool 28, is pulled completely over the container opening to the position shown in FIG. 3. Once the flame is extinguished the lid 22 may be reopened to a vertical position in the described manner, the grate 11 pivoted forwardly to the position shown in FIG. 4 and lids, not shown, can be placed on the fuel containers 31 for storage to prevent evaporation of the fuel.

The unit 10 as described above may be placed in a fire box 32 of any suitable design or used separately as a free standing unit. It is safe to operate insofar as products of combustion are concerned. However, adequate protection must be available to protect against placing the unit too close to unprotected combustible materials. The invention as described herein is a preferred embodiment. However, various modifications and/or changes can be made without departing from the scope of the invention which is to be limited only by the appended claims and functional equivalents thereto.

I claim:

1. A burner unit for burning unvented containerized alcohol fuels comprising (a) a support stand having opposing parallel horizontal side rails terminating at either end thereof by downwardly extending legs said side rails being interconnected by a pair of transverse support bars;

(b) a grate pivotally mounted between said side rails at the forward portion of said side rails and forward of said transverse support bars by pivot means and pivotable forwardly, said grate containing a fuel cell housing transversely mounted across the rear portions thereof, the rear portion of said grate and said fuel cell housing being positioned to rest over said transverse support bars when the grate is in an unpivoted position, said fuel cell housing having a channel to contain fuel containers comprising a floor and a front wall and a back lip extending upwardly at right angles from said floor, (c) a damper assembly comprising endwalls extending upwardly from said side rails and positioned to form ends to said fuel cell housing when said grate is in an unpivoted position, said endwalls having stop tabs extending inwardly at right angles at the rear edge thereof and an upper section extending above and behind said fuel cell housing and containing a generally horizontal offset slot therein said slot having a lower forward portion, an upwardly and backwardly intermediate slanting portion and a upper rearward portion terminating in a vertical plane rearwardly of the stop tabs, a damper lid generally rectangular in shape having guide tabs extending outwardly at the forward side ends thereof and having moving means on the top surface into which a tool may be inserted to move said lid in a forward or backward position, said damper lid being slidably mounted in the generally horizontal slot with said guide tabs being slidably positioned in said slot such that, when said guide tabs are in their forwardmost position in said lower forward slot portion, said damper lid will cover the top of said fuel cell housing, said guide tabs having a width less than the width of the slot such that, when said lid is moved backwardly along said slot, said guide tabs will rotate in said intermediate slanting slot portion causing the forward edge of said damper lid to rotate upwardly and, upon further rearward movement, cause said guide tabs and damper lid to rotate to a fully vertical position with the damper lid resting against said stop tabs when said guide tabs are moved to the back end of said upper rearward slot portion.

2. A burner unit as in claim 1 wherein said grate comprises a series of aligned grate bars terminating at the forward ends thereof by upward extensions, said grate bars being parallel with said side rails and wherein said fuel cell housing is transversely mounted across the rear portions of said bars.

3. A burner unit as in claim 2 containing an upper log holder extending between and interconnecting the upper end sections and being positioned over the upper rear slot portion of said upper end sections.

4. A burner unit as in claim 3 containing stop means extending inwardly from at least one downwardly extending leg at the forward portion of the support stand and positioned to limit the forward rotation of the grate to about 45°.

5. A burner unit as in claim 4 containing a first simulated log positioned on the grate behind the upward extensions of the grate bars, forward of the fuel cell housing and over the pivot means such that said grate will be weight balanced in either a pivoted or upright position.

6. A burner unit as in claim 5 wherein said first simulated log is positioned above the grate bar surfaces on log rests attached to the upper surface of said grate bars.

7. A burner unit as in claim 5 containing a second simulated log positioned in said upper log holder.

8. A burner unit as in claim 7 having fuel containers in said fuel cell housing.

9. A burner unit as in claim 8 wherein said fuel containers have a height that, when in the fuel cell housing, the top of the container may vary between the bottom of the lower forward groove to the top of the lower forward groove minus the thickness of the guide tabs.

10. A burner unit as in claim 7 wherein the slot at the end of the upper rear slot portion is enlarged.

11. A burner unit as in claim 8 in combination with a firebox.

* * * * *